US011205357B2

(12) United States Patent
Xiong et al.

(10) Patent No.: US 11,205,357 B2
(45) Date of Patent: Dec. 21, 2021

(54) DISPLAY PANEL TEST CIRCUIT AND DISPLAY PANEL

(71) Applicant: WUHAN CHINA STAR OPTOELECTRONICS SEMICONDUCTOR DISPLAY TECHNOLOGY CO., LTD., Hubei (CN)

(72) Inventors: Rui Xiong, Hubei (CN); Qi Cao, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 221 days.

(21) Appl. No.: 16/612,583

(22) PCT Filed: Feb. 21, 2019

(86) PCT No.: PCT/CN2019/075647
§ 371 (c)(1),
(2) Date: Nov. 11, 2019

(87) PCT Pub. No.: WO2020/118898
PCT Pub. Date: Jun. 18, 2020

(65) Prior Publication Data

US 2021/0335162 A1 Oct. 28, 2021

(30) Foreign Application Priority Data

Dec. 14, 2018 (CN) ..... 201811535705.8

(51) Int. Cl.
*G09G 3/00* (2006.01)
*G09G 3/3275* (2016.01)

(52) U.S. Cl.
CPC ..... *G09G 3/006* (2013.01); *G09G 3/3275* (2013.01); *G09G 2330/12* (2013.01)

(58) Field of Classification Search
None
See application file for complete search history.

(56) References Cited

FOREIGN PATENT DOCUMENTS

CN 106066560 A * 11/2016

* cited by examiner

*Primary Examiner* — Kirk W Hermann

(57) ABSTRACT

The display panel test circuit includes a first signal line, a first control line and a plurality of switching units, the first signal line comprises a first sub-signal line, a second sub-signal line and a plurality of third sub-signal lines, two ends of each of the third sub-signal lines are connected to the first sub-signal line and the second sub-signal line respectively. Each switching unit includes a first switching device, a control end thereof is connected to the first control line, an input end thereof is connected to the first sub-signal line, the output end of the first switching device is a test signal output end of the switching unit to which the first switching device belongs, and a portion of the first sub-signal line between any two adjacent switching units is connected to at least one third sub-signal line.

9 Claims, 2 Drawing Sheets

DISPLAY PANEL TEST CIRCUIT AND DISPLAY PANEL

CROSS REFERENCE TO RELATED APPLICATION

This application claims the priority of International Application No. PCT/CN2019/075647, filed on 2019 Feb. 21, which claims priority to Chinese Application No. 201811535705.8, filed on 2018 Dec. 14. The entire disclosures of each of the above applications are incorporated herein by reference.

BACKGROUND OF INVENTION

Field of Invention

The present invention relates to the field of display technologies, and in particular, to a display panel test circuit and a display panel.

Description of Prior Art

Organic light emitting display (OLED) has many advantages, such as self-luminous, low driving voltage, high luminous efficiency, short response times, high definition and contrast, near 180° viewing angles, wide temperature range, flexible and full-color display, etc., thereby OLED displays are recognized by the industry as the most promising display devices.

According to driving methods, OLED displays can be divided into two types: passive matrix OLED (PMOLED) and active matrix OLED (AMOLED), which are direct addressing and thin film transistor (TFT) matrix addressing. Among them, the AMOLED displays have pixels arranged in an array, belongs to an active display type, their luminous efficiencies are high, and are generally used as a high-definition large-sized display device.

The OLED device generally includes a substrate, an anode disposed on the substrate, a hole injection layer disposed on the anode, a hole transport layer disposed on the hole injection layer, a light emitting layer disposed on the hole transport layer, an electron transport layer disposed on the light-emitting layer, an electron injection layer disposed on the electron transport layer, and a cathode disposed on the electron injection layer. The principle of illumination of OLED devices is that semiconductor materials and organic luminescent materials are driven by electric fields, causing luminescence by the injection and recombination of carriers. Specifically, an OLED device generally uses an indium tin oxide (ITO) electrode and a metal electrode as an anode and a cathode of the device, respectively. Driven by a certain voltage, electrons and holes are injected from the cathode and anode to the electron transport layer and the hole transport layer, respectively. The electrons and holes migrate to the light emitting layer through the electron transport layer and the hole transport layer respectively and meet in the light emitting layer to form excitons and excite the light emitting molecules, and the light emitting molecules emit visible light through radiation relaxation.

Referring to FIG. 1, a conventional OLED display panel includes a substrate 100, a plurality of data lines 200 sequentially disposed on the substrate 100, and a test circuit 300 disposed on the substrate 100. The substrate 100 includes an effective display area (AA area) 110 and a terminal area 120 on the side of the effective display area 110. A plurality of data lines 200 are disposed in the effective display area 110 and each end of the plurality of data lines 200 extends to the terminal area 120. The test circuit 300 is disposed in the terminal area 120. Referring to FIG. 2, the test circuit 300 includes a first signal line 310, a second signal line 320, a first control line 330, a second control line 340, and a plurality of switch units 350. Each switch unit 350 corresponds to a data line 200, and each switch unit 350 includes a first field effect transistor (MOS transistor) Q10 and a second MOS transistor Q20. A gate of the first MOS transistor Q10 is connected to the first control line 330, a source of the first MOS transistor Q10 is connected to the first signal line 310, and the drain of the first MOS transistor Q10 is connected to the data line 200 corresponding to the switching unit 300. A gate of the second MOS transistor Q20 is connected to the second control line 340, a source of the second MOS transistor Q20 is connected to the second signal line 320, and the drain of the second MOS transistor Q20 is connected to the data line 200 corresponding to the switching unit 300. The first signal line 310 is used to access the red test signal D_r, and the second signal line 320 is used to access the blue test signal D_b. The first control line 330 is used to access the red control signal EN_r, and the second control line 340 is used to access the blue control signal EN_b. The first signal line 310 includes a first sub-signal line 311 and a second sub-signal line 312 and four third sub-signal lines 313. Two ends of the four third sub-signal lines 313 are connected to the first sub-signal line 311 and the second sub-signal line 312 respectively. The sources of the plurality of first MOS transistors Q1 are connected to the first sub-signal line 311. Connection points of the outer two of the four third sub-signal lines 313 and the first sub-signal line 311 are located on two sides of the region where the plurality of switch units 350 are located respectively. Connection points between the middle two of the four third sub-signal lines 313 and the first sub-signal line 311 are located between at connection points between two most intermediate sources of the MOS transistors Q10 and the first sub-signal line 311.

The purpose of the first signal line 310 is to reduce trace resistance of the first signal line 310 to eliminate voltage dropping of a red test signal on the first signal line 310 caused by the trace resistance. However, in practice, the effect of such a wiring design to improve the charging capability of the middle portion of the display panel is greater than the effect of improving the charging capability of the two sides of the display panel. The final display of the test screen is brighter in the middle and darker in the sides, resulting in an uneven display, which affects the test effect of the display panel.

SUMMARY OF INVENTION

An object of the present invention is to provide a display panel test circuit capable of ensuring a high brightness of a test picture and making the test picture display uniform.

Another object of the present invention is to provide a display panel capable of ensuring a high brightness of a test picture while making the test picture display uniform.

To achieve the above objects, the present invention provides a display panel test circuit comprising a first signal line, a first control line, and a plurality of switching units; wherein the first signal line and the first control line are spaced apart, the first signal line comprises a first sub-signal line, a second sub-signal line, and a plurality of third sub-signal lines, the first sub-signal line is spaced apart from the second sub-signal line, the plurality of third sub-signal lines are spaced apart, and two ends of each of the third sub-signal lines are connected to the first sub-signal line and the second sub-signal line respectively; and wherein the plurality of switching units are sequentially arranged and spaced from each other, each switching unit comprises a first switching device, a control end of the first switching device is connected to the first control line, an input end of the first switching device is connected to the first sub-signal line, the output end of the first switching device is a test signal output end of the switching unit to which the first switching device belongs, and a portion of the first sub-signal line between any two adjacent switching units is connected to at least one third sub-signal line.

Connection points of two outermost third sub-signal lines of the plurality of third sub-signal lines and the first sub-signal line are respectively located at two sides of the region where the plurality of switching units are located.

The number of the switching units is 2n, wherein n is a positive integer greater than 1, a portion of the first sub-signal line between (n−1)th switching unit and nth switching unit is connected with two third sub-signal lines, and a portion of the first sub-signal line between any two adjacent switching units except a combination of the (n−1)th switching unit and the nth switching unit is connected to a third sub-signal line.

The plurality of switching units are disposed between the first sub-signal line and the second sub-signal line.

The first control line is connected to a red control signal, and the first signal line is connected to a red test signal.

The first control line is disposed on a side of the second sub-signal line away from the first sub-signal line.

The display panel test circuit further comprising a second signal line and a second control line, wherein the first signal line, the second signal line, the first control line, and the second control line are sequentially arranged and spaced from each other;

wherein each of the switching units comprises a second switching device, a control end of the second switching device is connected to the second control line, an input end of the second switching device is connected to the second signal line, and an output end of the second switching device is connected to an output end of the first switching device of the switching unit to which the second switching device belongs to.

The second control line is connected to a blue control signal, and the second signal line is connected to a blue test signal.

The first switching device is a first metal oxide semiconductor (MOS) transistor, the control end of the first switching device is a gate of the first MOS transistor, the input end of the first switching device is a source of the first MOS transistor, the output end of the first switching device is a drain of the first MOS transistor; the second switching device is a second MOS transistor, the control end of the second switching device is a gate of the second MOS transistor, the input end of the second switching device is a source of the second MOS transistor, the output of the second switching device is a drain of the second MOS transistor.

The present invention further provides a display panel comprising a substrate, a plurality of data lines sequentially spaced apart on the substrate, and a display panel test circuit disposed on the substrate; wherein the display panel test circuit is the display panel test circuit according to claim 1;

the plurality of data lines connect to the test signal output ends of the plurality of switching units in the display panel test circuit respectively.

The display panel test circuit comprises a first signal line, a first control line, and a plurality of switching units, the first signal line comprises a first sub-signal line, a second sub-signal line, and a plurality of third sub-signal lines, two ends of each of the third sub-signal lines are connected to the first sub-signal line and the second sub-signal line respectively. Each switching unit includes a first switching device, a control end of the first switching device is connected to the first control line, an input end of the first switching device is connected to the first sub-signal line, the output end of the first switching device is a test signal output end of the switching unit to which the first switching device belongs, and a portion of the first sub-signal line between any two adjacent switching units is connected to at least one third sub-signal line. The invention can reduce the resistance of the first signal line, so that the voltage dropping of the test signal accessed by the first signal line is small, and the brightness of the test picture is high. At the same time, the voltage of the input terminals of the respective first switching devices are kept consistent, so that the test screen is displayed uniformly. The display panel of the present invention can ensure that the test picture has high brightness and makes the test picture display uniform at the same time.

BRIEF DESCRIPTION OF DRAWINGS

In order to describe clearly the embodiment in the present disclosure or the prior art, the following will introduce the drawings for the embodiment shortly. Obviously, the following description is only a few embodiments, for the common technical personnel in the field it is easy to acquire some other drawings without creative work.

DETAILED DESCRIPTION OF PREFERRED EMBODIMENTS

In order to further clarify the technical means and effects of the present invention, the following detailed description will be made in conjunction with the preferred embodiments of the invention and the accompanying drawings.

Figure 1:
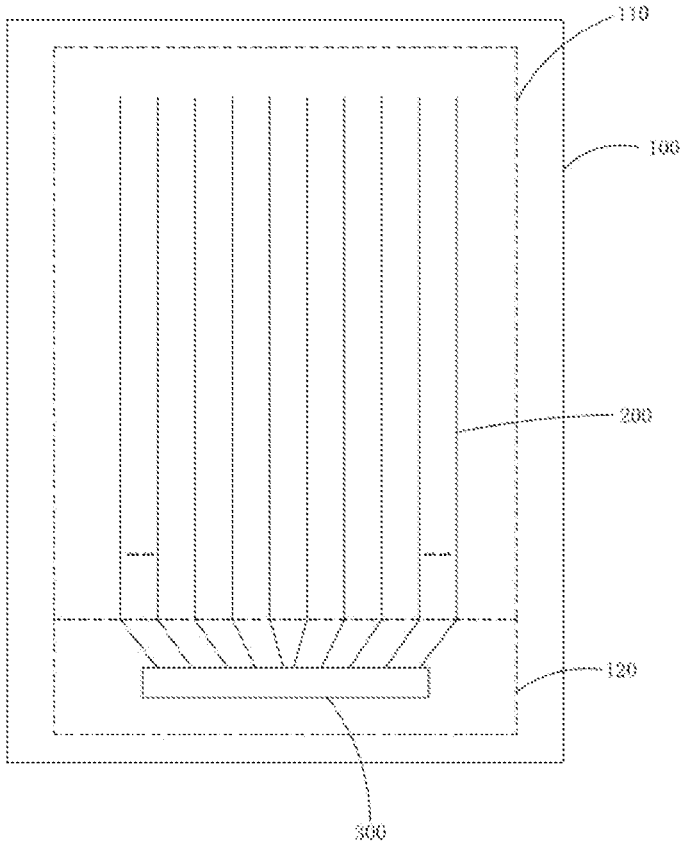
FIG. 1 (PRIOR ART )
FIG. 1 is a schematic structural diagram of a conventional OLED display panel.
Figure 2:
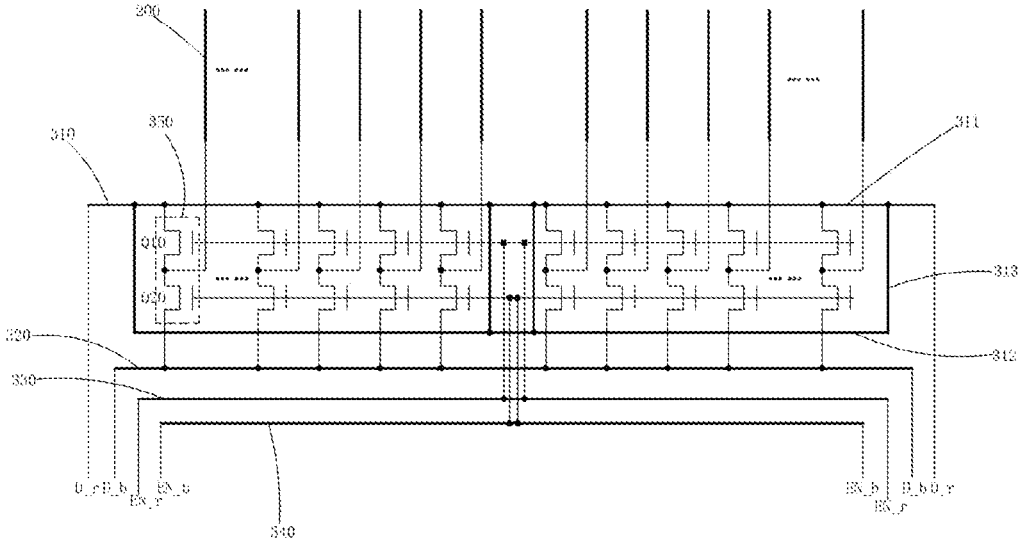
FIG. 2 (PRIOR ART)
FIG. 2 is a schematic structural diagram of a test circuit of a conventional OLED display panel.
Figure 3:
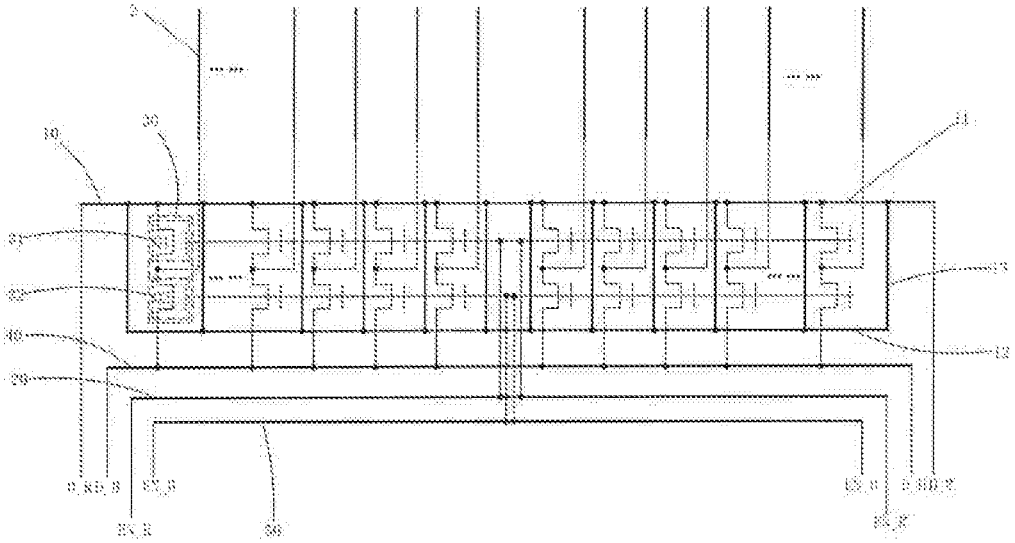
FIG. 3 is a schematic structural diagram of a display panel test circuit of the present invention.

Referring to FIG. 3, the present invention provides a display panel test circuit including a first signal line 10, a first control line 20, and a plurality of switching units 30.

The first signal line 10 and the first control line 20 are spaced apart, the first signal line 10 comprises a first sub-signal line 11, a second sub-signal line 12, and a plurality of third sub-signal lines 13, the first sub-signal line 11 is spaced apart from the second sub-signal line 12, the plurality of third sub-signal lines 13 are spaced apart, and two ends of each of the third sub-signal lines 13 are connected to the first sub-signal line 11 and the second sub-signal line 12 respectively.

The plurality of switching units 30 are sequentially arranged and spaced from each other, each switching unit comprises a first switching device 31, a control end of the first switching device 31 is connected to the first control line 20, an input end of the first switching device 31 is connected to the first sub-signal line 11, the output end of the first switching device 31 is a test signal output end of the switching unit to which the first switching device 31 belongs, and a portion of the first sub-signal line 11 between any two adjacent switching units 30 is connected to at least one third sub-signal line.

Connection points of two outermost third sub-signal lines 13 of the plurality of third sub-signal lines 13 and the first sub-signal line 11 are located at two sides of the region where the plurality of switching units 30 are located respectively.

The number of the switching units 30 is 2n, wherein n is a positive integer greater than 1, a portion of the first sub-signal line 11 between (n−1)th switching unit 30 and nth switching unit 30 is connected with two third sub-signal lines 13. A portion of the first sub-signal line 11 between any two adjacent switching units 30 except a combination of the (n−1)th switching unit 30 and the nth switching unit 30 is connected to a third sub-signal line 13.

The plurality of switching units 30 are disposed between the first sub-signal line 11 and the second sub-signal line 12.

The first control line 20 is connected to a red control signal EN_R, and the first signal line 10 is connected to a red test signal D_R.

The first control line 20 is disposed on a side of the second sub-signal line 12 away from the first sub-signal line 11.

The display panel test circuit further including a second signal line 40 and a second control line 50. The first signal line 10, the second signal line 40, the first control line 20, and the second control line 50 are sequentially arranged and spaced from each other.

Each of the switching units 30 comprises a second switching device 32, a control end of the second switching device 32 is connected to the second control line 50, an input end of the second switching device 32 is connected to the second signal line 40, and an output end of the second switching device 32 is connected to an output end of the first switching device 31 of the switching unit 30 to which the second switching device 32 belongs to. The second control line 50 is connected to the blue control signal EN_B, and the second signal line 40 is connected to the blue test signal D_B.

The first switching device 31 is a first metal oxide semiconductor (MOS) transistor Q1, the control end of the first switching device 31 is a gate of the first MOS transistor Q1, the input end of the first switching device 31 is a source of the first MOS transistor Q1, the output end of the first switching device 31 is a drain of the first MOS transistor Q1. The second switching device 32 is a second MOS transistor Q2, the control end of the second switching device 32 is a gate of the second MOS transistor Q2, the input end of the second switching device 32 is a source of the second MOS transistor Q2, the output of the second switching device 32 is a drain of the second MOS transistor Q2.

It should be noted that, in the display panel test circuit of the present invention, the first sub-signal line 11, the second sub-signal line 12 and the plurality of third sub-signal lines 13 are disposed in the first signal line 10, the control end of the first switching device 31 of each switching unit 30 is connected to the first control line 20, the input terminal of the first switching device 31 is connected to the first sub-signal line 11, the output end of the first switching device 31 is a test signal output end of the switch unit 30 where the first switching device 31 is located, and the output end is connected to a data line 2 in the display panel. Because the first signal line 10 includes the first sub-signal line 11, the second sub-signal line 12, and the third sub-signal line 13, the total resistance of the first signal line 10 is effectively reduced. Thereby the voltage dropping of the first signal line 10 connecting to the red test signal D_R is small. The first signal line 10 transmits the red test signal D_R from the first switching device 31 of the plurality of switch units 30 to the plurality of data lines 2 of the display panel, and drives the display panel to display a test screen, so that the test screen can have a higher brightness. Meanwhile, because at least one third sub-signal line 13 is connected to a portion of the first sub-signal line 11 between any two adjacent switching units 30, the input terminals of the respective first switching devices 31 are connected during testing. The voltage value of the red test signal D_R is kept consistent, so that the voltage values received by the data lines 2 of the display panel are the same. Compared with the prior art, the problem that the test screen is brighter on the center and is darker on both sides can be eliminated, so that the test screen is displayed uniformly, and the panel test is facilitated.

Figure 4:
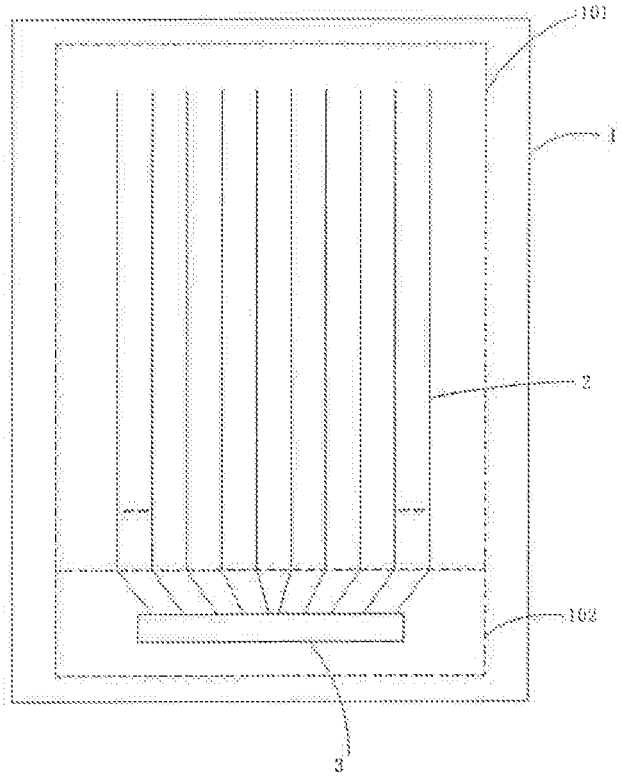
FIG. 4 is a schematic structural diagram of a display panel of the present invention.

Referring to FIG. 4, and combining with FIG. 3, the present invention further provides a display panel including a substrate 1, a plurality of data lines 2 sequentially spaced apart on the substrate 1, and a display panel test circuit disposed on the substrate 1. Referring to FIG. 3, the display panel test circuit is the above display panel test circuit, and the structure of the display panel test circuit is not repeatedly described herein. A plurality of data lines 2 are connected to test signal output ends of the plurality of switching units 30 in the display panel test circuit respectively.

Specifically, referring to FIG. 4, the substrate 1 includes an effective display area 101 and a terminal area 102 on one side of the effective display area 101. The plurality of data lines 2 are all located in the effective display area 101 and each end extends to the terminal area 102, the display panel test circuit is disposed in the terminal area 102, specifically between the chip (integrated circuit, IC) terminal and the chip output terminal. The display panel can be an OLED display panel or a liquid crystal display panel.

It should be noted that, in the display panel test circuit of the present invention, the first sub-signal line 11, the second sub-signal line 12 and the plurality of third sub-signal lines 13 are disposed in the first signal line 10, the control end of the first switching device 31 of each switching unit 30 is connected to the first control line 20, the input terminal of the first switching device 31 is connected to the first sub-signal line 11, the output end of the first switching device 31 is a test signal output end of the switch unit 30 where the first switching device 31 is located, and the output end is connected to a data line 2 in the display panel. Because the first signal line 10 includes the first sub-signal line 11, the second sub-signal line 12, and the third sub-signal line 13, the total resistance of the first signal line 10 is effectively reduced. Thereby the voltage dropping of the first signal line 10 connecting to the red test signal D_R is small. The first signal line 10 transmits the red test signal D_R from the first switching device 31 of the plurality of switch units 30 to the plurality of data lines 2 of the display panel, and drives the display panel to display a test screen, so that the test screen can have a higher brightness. Meanwhile, because at least one third sub-signal line 13 is connected to a portion of the first sub-signal line 11 between any two adjacent switching units 30, the input terminals of the respective first switching devices 31 are connected during testing. The voltage value of the red test signal D_R is kept consistent, so that the voltage values received by the data lines 2 of the display panel are the same. Compared with the prior art, the problem that the test screen is brighter on the center and is darker on both sides can be eliminated, so that the test screen is displayed uniformly, and the panel test is facilitated.

The display panel test circuit comprises a first signal line, a first control line, and a plurality of switching units, the first signal line comprises a first sub-signal line, a second sub-signal line, and a plurality of third sub-signal lines, two ends of each of the third sub-signal lines are connected to the first sub-signal line and the second sub-signal line respectively. Each switching unit includes a first switching device, a control end of the first switching device is connected to the first control line, an input end of the first switching device is connected to the first sub-signal line, the output end of the first switching device is a test signal output end of the switching unit to which the first switching device belongs, and a portion of the first sub-signal line between any two adjacent switching units is connected to at least one third sub-signal line. The invention can reduce the resistance of the first signal line, so that the voltage dropping of the test signal accessed by the first signal line is small, and the brightness of the test picture is high. At the same time, the voltage of the input terminals of the respective first switching devices are kept consistent, so that the test screen is displayed uniformly. The display panel of the present invention can ensure that the test picture has high brightness and makes the test picture display uniform at the same time.

As is understood by persons skilled in the art, the foregoing preferred embodiments of the present disclosure are illustrative rather than limiting of the present disclosure. It is intended that they cover various modifications and that similar arrangements be included in the spirit and scope of the present disclosure, the scope of which should be accorded the broadest interpretation so as to encompass all such modifications and similar structures.

What is claimed is:

1. A display panel test circuit comprising a first signal line, a first control line, and a plurality of switching units; wherein the first signal line and the first control line are spaced apart, the first signal line comprises a first sub-signal line, a second sub-signal line, and a plurality of third sub-signal lines; the first sub-signal line is spaced apart from the second sub-signal line, the plurality of third sub-signal lines are spaced apart, and two ends of each of the third sub-signal lines are connected to the first sub-signal line and the second sub-signal line, respectively; and wherein the plurality of switching units are sequentially arranged and spaced from each other, each switching unit comprises a first switching device, a control end of the first switching device is connected to the first control line, an input end of the first switching device is connected to the first sub-signal line, an output end of the first switching device is a test signal output end of the switching unit to which the first switching device belongs, and a portion of the first sub-signal line between any two adjacent switching units is connected to at least one third sub-signal line.

2. The display panel test circuit according to claim 1, wherein connection points of two outermost third sub-signal lines of the plurality of third sub-signal lines and the first sub-signal line are located at two sides of a region where the plurality of switching units are located respectively.

3. The display panel test circuit according to claim 1, wherein a number of the switching units is 2n, wherein n is a positive integer greater than 1, a portion of the first sub-signal line between an (n−1)th switching unit and an nth switching unit is connected with two third sub-signal lines, and a portion of the first sub-signal line between any two adjacent switching units except a combination of the (n−1)th switching unit and the nth switching unit is connected to a third sub-signal line.

4. The display panel test circuit of claim 1, wherein the plurality of switching units are disposed between the first sub-signal line and the second sub-signal line.

5. The display panel test circuit of claim 1, wherein the first control line is connected to a red control signal, and the first signal line is connected to a red test signal.

6. The display panel test circuit according to claim 1, wherein the first control line is disposed on a side of the second sub-signal line away from the first sub-signal line.

7. The display panel test circuit of claim 1, further comprising a second signal line and a second control line, wherein the first signal line, the second signal line, the first control line, and the second control line are sequentially arranged and spaced from each other;

wherein each of the switching units comprises a second switching device, a control end of the second switching device is connected to the second control line, an input end of the second switching device is connected to the second signal line, and an output end of the second switching device is connected to an output end of the first switching device of the switching unit to which the second switching device belongs to.

8. The display panel test circuit of claim 7, wherein the second control line—is connected to a blue control signal, and the second signal line is connected to a blue test signal.

9. A display panel comprising a substrate, a plurality of data lines sequentially spaced apart on the substrate, and a display panel test circuit disposed on the substrate; wherein the display panel test circuit is the display panel test circuit according to claim 1;

the plurality of data lines connect to the test signal output ends of the plurality of switching units in the display panel test circuit respectively.

* * * * *